US008316512B2

(12) United States Patent
Halldin

(10) Patent No.: US 8,316,512 B2
(45) Date of Patent: Nov. 27, 2012

(54) APPARATUS AT A PROTECTIVE HELMET

(75) Inventor: Peter Halldin, Stockholm (SE)

(73) Assignee: MIPS AB, Stockholm (SE)

( * ) Notice: Subject to any disclaimer, the term of this patent is extended or adjusted under 35 U.S.C. 154(b) by 517 days.

(21) Appl. No.: 12/527,396

(22) PCT Filed: Feb. 20, 2008

(86) PCT No.: PCT/SE2008/000141
§ 371 (c)(1),
(2), (4) Date: Jan. 26, 2010

(87) PCT Pub. No.: WO2008/103107
PCT Pub. Date: Aug. 28, 2008

(65) Prior Publication Data

US 2010/0115686 A1 May 13, 2010

(30) Foreign Application Priority Data

Feb. 20, 2007 (SE) ..... 0700412

(51) Int. Cl.
*A42B 3/06* (2006.01)

(52) U.S. Cl. ..... 24/90.1; 2/411

(58) Field of Classification Search ..... 2/410–412, 2/414, 425; 24/90.1, 114.3
See application file for complete search history.

(56) References Cited

U.S. PATENT DOCUMENTS

| | | | | |
|---|---|---|---|---|
| 4,307,471 | A * | 12/1981 | Lovell | 2/411 |
| 6,332,226 | B1 * | 12/2001 | Rush, III | 2/412 |
| 6,658,671 | B1 * | 12/2003 | Von Holst et al. | 2/412 |
| 2004/0117896 | A1 * | 6/2004 | Madey et al. | 2/411 |
| 2005/0257312 | A1 | 11/2005 | Puchalski | |

FOREIGN PATENT DOCUMENTS

WO WO 2006/022680 3/2006

* cited by examiner

*Primary Examiner* — James Brittain
(74) *Attorney, Agent, or Firm* — Holland & Hart LLP

(57) ABSTRACT

The present technology relates to a locking device (2) for fixation of the position of an outer layers (4) relatively an inner layer (6) of a protective helmet (3), which protective helmet has a sliding layer (8) arranged between the outer layer and the inner layer, for facilitating displacement of the outer layer relatively the inner layer during an oblique impact towards the protective helmet. The locking device (2) comprises a layer-guiding member (10), that has an upper portion (12), which upper portion (12) is intended to be arranged in an opening (13) in the outer layer (4), and a resilient lower portion (16), extending from the upper portion (12), that in its free end (17) is arranged in connection to the inner layer (6). The present technology also relates to a protective helmet (3) comprising the locking device (2).

11 Claims, 2 Drawing Sheets

APPARATUS AT A PROTECTIVE HELMET

TECHNICAL FIELD

The present invention relates to a locking device for a protective helmet, and a protective helmet comprising the locking device, respectively. The protective helmet comprises an outer layer, an inner layer arranged behind the outer layer intended for contact with the head of the wearer, and a sliding layer arranged between the outer layer and the inner layer that facilitates displacement of the outer layer relatively the inner layer at an oblique impact towards the protective helmet.

BACKGROUND

A protective helmet of the above mentioned kind is previously known from the patent document EP-A1-1246548. This protective helmet is marketed under the name MIPS™. The MIPS™ protective helmet aim at reducing the energy that is transferred to the brain during oblique impacts. The protective helmet comprises an outer layer and an inner layer, also called "liner". Between the liner and the outer layer there is one or more sliding layers, that allows the outer layer and the liner to be displaced with low friction relatively each other. For example, the sliding layer may compose of oil, air, TEFLON or the like. Additionally, the protective helmet comprises an energy-absorbing elastic connecting member that, during displacement of the outer layer relatively the "liner" during an oblique impact towards the helmet, is deformed and absorbs impact energy.

A protective helmet of the above-mentioned kind may for instance be designed such that the outer and inner layers and the sliding layer during a displacement are deformed, and thus such that the protecting ability of the helmet is consumed. With respect to the protective helmet according to the above-mentioned patent document EP-A1-1246548, the energy-absorbing elastic connecting members can be designed such that they are deformed and thus are consumed at a displacement of the layers. Under certain circumstances there is a need for a protective helmet which to some extent delimit the displacement of the layers relatively each other. Such a circumstance is for example that a relative displacement of the layers are not desired when the protective helmet is exposed for insignificant or low loads that do not imply any risk for brain damages of the helmet wearer. One example is some degree of careless handling e.g. during gentle impacts when the wearer has taken off the helmet and happens to drop it, from a height, in the floor. Another example is careless conveyance handling at delivery of newly-produced helmets.

If the helmet has been influenced such that an energy-absorbing part, alternatively an elastic connecting member, has been activated/deformed and thus has been consumed at a displacement of the layers, it is necessary to be able to fast and unambiguously establish, without any complicated inspection, that the helmet is consumed, or alternatively that the helmet have to be repaired or taken care of for resetting to its original unaffected condition.

DESCRIPTION OF THE INVENTION

It is a general object with the present invention to at least partially eliminate those drawbacks that are associated with apparatuses according to the state of the art. One object with the present invention is to achieve that the helmet is experienced as sturdy when removed and put on, respectively, and that the outer layer not should move or vibrate relatively the inner layer, at least not noticeable for the wearer of the helmet, during use of the helmet, e.g. when the helmet is exposed for high speed and large wind resistance during use. A further object with the present invention is to achieve an improvement and further development of a protective helmet that comprises a sliding layer that permits displacement of an outer layer relatively an inner layer. Yet an additional object with the present invention is to achieve an apparatus and a protective helmet that makes it possible to simply be able to determine if the protective helmet has been subjected to influence such that its function for energy-absorption has been consumed.

These objects have been reached with a locking device for a protective helmet, respectively a protective helmet, according to the present invention as defined in the appended independent claims.

Thus, the lower portion is designed to resiliently extend from said first position, when the lower portion is subjected for a traction force from the upper portion, when the upper portion is moved to the second position, during displacement of the outer layer relatively the inner layer. In that respect, the lower portion has material properties and/or a design/dimension such that said resilience can be achieved. The lower portion may suitably be made of a plastic material, rubber, or the like.

An advantage with this solution according to the invention is that the energy-absorbing properties of the protective helmet only are activated when the helmet is subjected to oblique impacts that exceed a certain power. One additional advantage according to the present invention is that the helmet will not be useless if it is handled careless during transportation, common use etc. With the solution according to the present invention it is possible, for said protective helmet, to prevent that the outer layer hardly moves, begin to shake, "wobble" etc, when the helmet is subjected for lower loads, e.g. at high speeds, large wind resistance etc.

One further advantage with the locking device and the protective helmet according to the present invention is that it is possible to easily, fast, unambiguously and simply to be able to determine if the protective helmet has been subjected to agitation, that is if a displacement of the layers has taken place and the energy-absorbing function has been released, whereby the helmet is consumed, at least for the moment, by indication of that on the outside of the helmet. Various design of the display members are possible, for providing said indication of the released energy-absorbing function, that can be view on the outside of the helmet, within the scope of protection of the present invention.

The position fixation of the layers that is obtained by means of the locking device may preferably be designed such that it stops at a tangential force that is within the range of about 10-1000N, which thus is the force that is required for releasing a displacement of the outer layer relatively the inner layer at an oblique impact, that is at a tangential force directed towards the outer layer. By "force" is meant the total force, active between the outer layer and the inner layer.

In a preferred embodiment of the present invention, the inner layer is formed with a cup-shaped portion, where a tapering portion of the layer-guiding member and the cup-shaped portion abut against each other, at least at an oblique portion of the layer-guiding member, whereby the upper portion with the tapering portion of the layer-guiding member can be displaced relatively the cup-shaped portion of the inner layer, when the position attachment ceases. The portion where the cup-shaped portion of the inner layer, respectively the oblique portion of the layer-guiding member abuts against each other, is a low friction layer. The coefficient of friction in the low friction layer is preferably within the range 0.05-0.3.

In accordance with the present invention, the outer layer and the inner layer can have a design and be made of a material such as proposed in EP-A1-1246548. In that respect, a possibly used sliding layer may be made up of one or more layers of a material that provides low friction between outer layer and inner layer during displacement of those layers. Teflon, TEFLON, oil, air or the similar are example of such materials. The outer layer is preferably of a relatively thin layer of hard and strong material, such as fibre-reinforced plastics. The inner layer is preferably of a relatively thick layer of e.g. polyurethane foam, polystyrene or the similar.

In accordance with the present invention, the energy-absorption of the protective helmet, that is absorption of impact energy at a displacement of the outer layer relatively the liner at an oblique impact towards the helmet that exceeds a certain load, may occur in several ways. Energy-absorption of the protective helmet takes place at least by the displacement of the layers in itself. The created impact energy is decreased by friction. By friction, a certain part of the rotational energy is absorbed and distributed by the inner layer (liner). The load distribution occurs over a large area by permitting sliding of the layers. According to an embodiment, the lower portion of the layer-guiding member may by itself be designed to be energy-absorbing. In this case, the lower portion can be designed with material properties such that the impact energy is absorbed during deformation of the lower portion, when the lower portion is resiliently extended from said first position, that is when the lower portion is subjected to a traction force from the upper portion, during displacement of the layers after exceeding of a certain force at an oblique impact towards the helmet. The protective helmet may also comprise an energy-absorbing elastic connecting member, having e.g. the design as evident from the above mention EP-A1-1246548.

Additional preferred features, advantages and favourable embodiments of the invention, are evident from the dependent claims, and also in the following from description of the embodiments.

DESCRIPTION OF THE DRAWINGS

The present invention will now be described more in detail by examples of application, by reference to the accompanying drawings, without limiting the interpretation of the invention thereto, where FIG. 1A schematically shows a cross-section of the locking device according to an embodiment of the present invention, arranged to the layers of a protective helmet (partly shown), here positioned in the first position (P1), FIG. 1B schematically shows a cross-section of the locking device in FIG. 1A, arranged to the layers of a protective helmet (partly shown), here positioned in the second position (P2)

DETAILED DESCRIPTION OF EMBODIMENTS

Figure 1A:
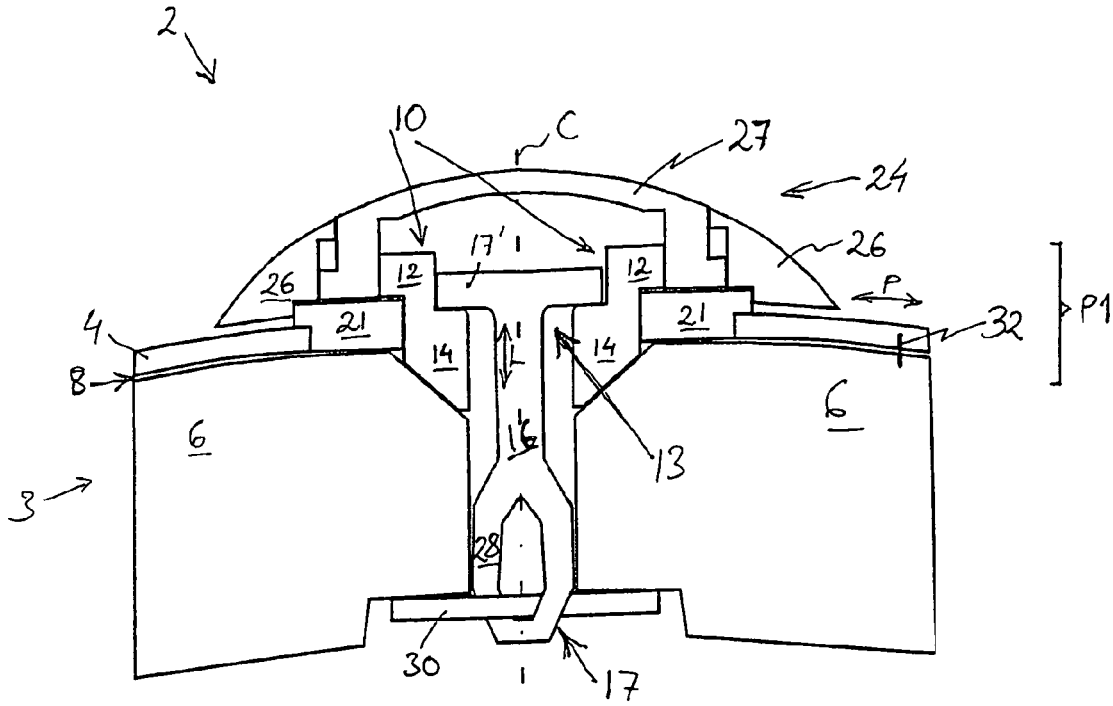
Figure 1B:
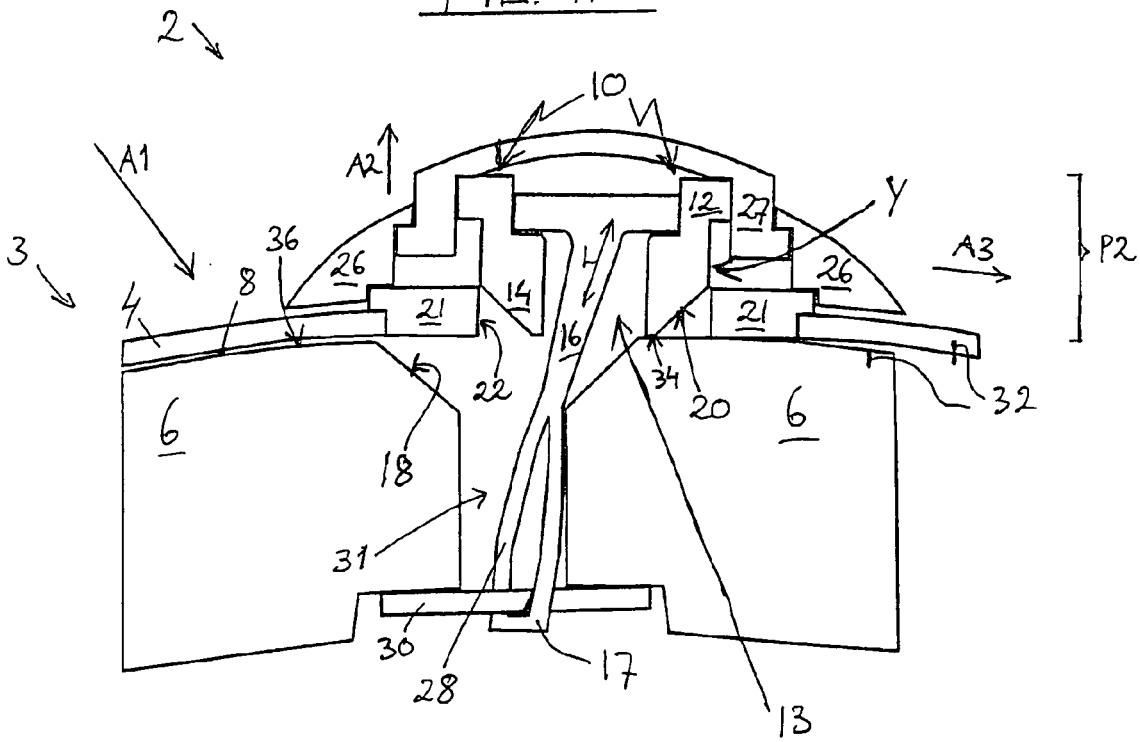

FIG. 1A-B shows an embodiment of a locking device 2 arranged at a section of a protective helmet 3, suitably on the highest situated position on the outer layer when the helmet is carried on the head of a user, in accordance with the present invention, The protective helmet 3 comprises an outer layer 4 and an inner layer 6, arranged within the outer layer, which also can be called "liner". A sliding layer 8 is suitably arranged between the outer layer and the inner layer, for displacement of the outer layer 4 relatively the inner layer 6 at an oblique impact A1 towards the protective helmet 3.

Furthermore, FIG. 1A shows the locking device 2 according to the present invention in a condition where it limits or prevents substantial displacement of the layers 4, 6 of the protective helmet 3 relative each other, when the protective helmet is subjected to insignificant or low loads that does not imply any risk for brain damages of the wearer of the helmet.

FIG. 1B shows the locking device in FIG. 1A in a condition where displacement of the layers 4, 6 of the protective helmet 3 relatively each other has taken place. The locking device 2, which also can be said to be a kind of releasing mechanism, is designed such that the position attachment of the layers 4, 6, by means of the locking device, stops at an oblique impact A1, that is at a tangential force e.g. in the range of about 10-1000N, whereby a displacement of the outer layer 4 relatively the inner layer is admitted.

The locking device 2, as evident from FIGS. 1A-B, comprises a layer-guiding member 10, that has an upper portion 12 with a chamfered, tapering portion 14. The upper portion 12 is intended to be arranged in an opening 13 in the outer layer 4 and adjacent to the outer layer 4. The layer-guiding member further comprises a resilient, long and narrow lower portion 16, extending from the upper portion 12, that in its free end 17 is arranged in connection to the inner layer 6. As evident in the shown embodiment, the lower portion 16 can be a separate part that either is arranged fixed or releasably arranged in its upper end 17' to the upper portion 12 of the layer-guiding member. The lower portion 16 has material properties and/or design/dimensions such that said resilience can be provided. The lower portion 16 can be designed with material properties such that impact energy is absorbed during deformation of the lower portion, when the lower portion 16 resiliently is extended from said first position P1. The upper portion 12 is arranged in a first position P1 relatively the inner layer 6, in such a way that the outer layer 4 is fixed in position relatively the inner layer 6 in a condition without load, or during insignificant load on the protective helmet. In the first position P1 the locking device is centered and symmetrically arranged around a central axle C in the protective helmet 3. The locking device 2 is arranged such that the fixed position ends at exceeding of a certain load towards the protective helmet, owing to that the lower portion 16 of the layer-guiding member 10 can be elastic in its longitudinal direction L and in the direction of propagation plane P of the inner layer and the outer layer 4, 6. In such way the upper portion 12 can be moved to a second position P2 relatively the inner layer 6, during displacement of the outer layer 4 relatively the inner layer 6.

The inner layer 6 is designed with a cup-shaped portion 18, that may have a design that at least partially is form-fitted similarly to the shape of the tapering portion 14 of the layer-guiding member 10 along an oblique section or an oblique surface 20, where the tapering section 14 and the cup-shaped portion 18 abuts against each other. The oblique surface 20 of the layer-guiding member 10 is intended to be arranged in abutment towards the cup-shaped portion 18 in the protective helmet. Displacement of the upper portion 12 of the layer-guiding member 10 occurs at the tapering portion 14 relatively the cup-shaped portion 18 of the inner layer 6, when the fixed positioning ends. The cup-shaped portion 18 of the inner layer 6 and the oblique section of the layer-guiding member 10, respectively, where they abuts towards each other, can be curved surfaces, that have corresponding and matching shapes to each other. The cup-shaped portion 18 and the oblique section, respectively, may also be flat surfaces, which is a preferred embodiment. If it is flat surfaces, the inclination is suitably in the range 30-60° relatively the propagation plane P.

The locking device may comprise a ring-formed washer 21 that is fixed in the opening 13 to the outer layer 4. In the ring-formed washer 21, the upper portion 12 is displacebly arranged in an opening 22 of the ring-formed washer 21 adjacent to the outer layer 4.

A button device 24 may suitably be arranged to the outer layer on the outside of the protective helmet adjacent to, and in displaceable cooperation with, the upper portion 12 of the guiding member 10. The button device 24 is arranged such that it indicates when said position attachment has ceased and displacement of the outer layer 4 relatively the inner layer 6 has taken place. The button device 24 is made up of two parts, one outer button part 26, attached to the outer layer 4 or to the ring-formed washer 21, and one inner button part 27 displaceable in the outer button part 26.

The resilient long and narrow lower portion 16 may comprise a ring-shaped portion 28 in the free end 17, that is intended to be arranged in said connection with the inner layer 6. A stop member 30 can be arranged to the inner layer 6 and in connection to the free end 17, such that the free end 17 is retained in its position during movement of the upper position 12 to the second position P2. FIG. 1A shows the lower portion 16 arranged in a substantially unstrained, unloaded condition. However, it is possible to arrange the lower portion 16 in a prestressed condition. In the embodiment shown in the drawings it is shown that the lower portion 16 is arranged in a through channel 31 in the inner layer 6. Although if advantageous from a production and assembly point of view, this is not necessary. According to an embodiment, the free end 17 of the lower portion 16 of the layer-guiding member could e.g. be attached in the bottom of the cup-shaped portion 18 in the inner layer 6.

The upper portion 12 of the layer-guiding member 10 may have an angular shape (not shown) around its circumferential surface Y, such as square-shaped or eight-sided shape, in a cross-section seen perpendicular to the plane of the paper (not shown). An angular shape may allow the layer-guiding member to lock/fix the layers relatively each other in a position in the first position P1 such that they not can rotate relatively each other. The other parts of the locking device, such as the upper end of the lower portion 16, the button device 24, the ring-formed washer 21, may suitably have a circular form seen in a plane view (perpendicular to the plane of the paper).

The protective helmet according to the present invention may also comprise at least one attachment member 32, in the shape of a pin, a plug, a bulge, a bump, a strip, a band, a shoulder, a joint, or the similar, which attachment member 32 secures the outer layer 4 relatively the inner layer 6 in unloaded condition, or at insignificant load towards the protective helmet. The attachment member 32 is arranged such that the fixed connection ends, e.g. owing to that it is broken off such as is evident in FIG. 1B, when exceeding a certain load towards the protective helmet.

In exemplifying purpose, the function of the protective helmet according to the present invention is here below described by reference to FIG. 1B, comprising a locking device according to the present invention. The fixation of the position of the layers 4, 6 by the locking device 2 ends at an oblique impact A1, that is at a tangential force for instance in the range of about 10-1000N, whereby a displacement of the outer layer 4 relatively the inner layer 6 is admitted. At the oblique impact A1, a displacement A3 occurs of the outer layer 4 relatively the inner layer 6, whereby the opening 13 in the outer layer, or the opening 22 of the preferred ring-formed washer 21, pushes towards the upper portion 12 of the layer-guiding member 10. Thereby a simultaneous upwardly directed displacement A2 of the upper portion 12 takes place by sliding of the oblique section 20 of the tapering portion 14 along the cup-shaped portion 18 of the inner layer 6, along the section were the surfaces abut towards each other. As evident from FIG. 1B, the long and narrow lower portion 16 is shaped to resiliently extend from said first position P1 (see FIG. 1A), when the lower portion 16 is subjected to a traction force from the upper portion 12, when the upper portion is moved to the second position P2. The upper portion 12 of the layer-guiding member 10 is displaced upwards A2, whereby the inner button part 27 of the button device 24 is displaced upwards, in direction A2 out from the outer button part 26. As evident from FIG. 13, the upper portion 12 may completely be displaced out off the opening 13, 22, and with a part of its lowest bottom surface 34 positioning itself on an upper surface 36 of the inner layer 6.

Figure 2:
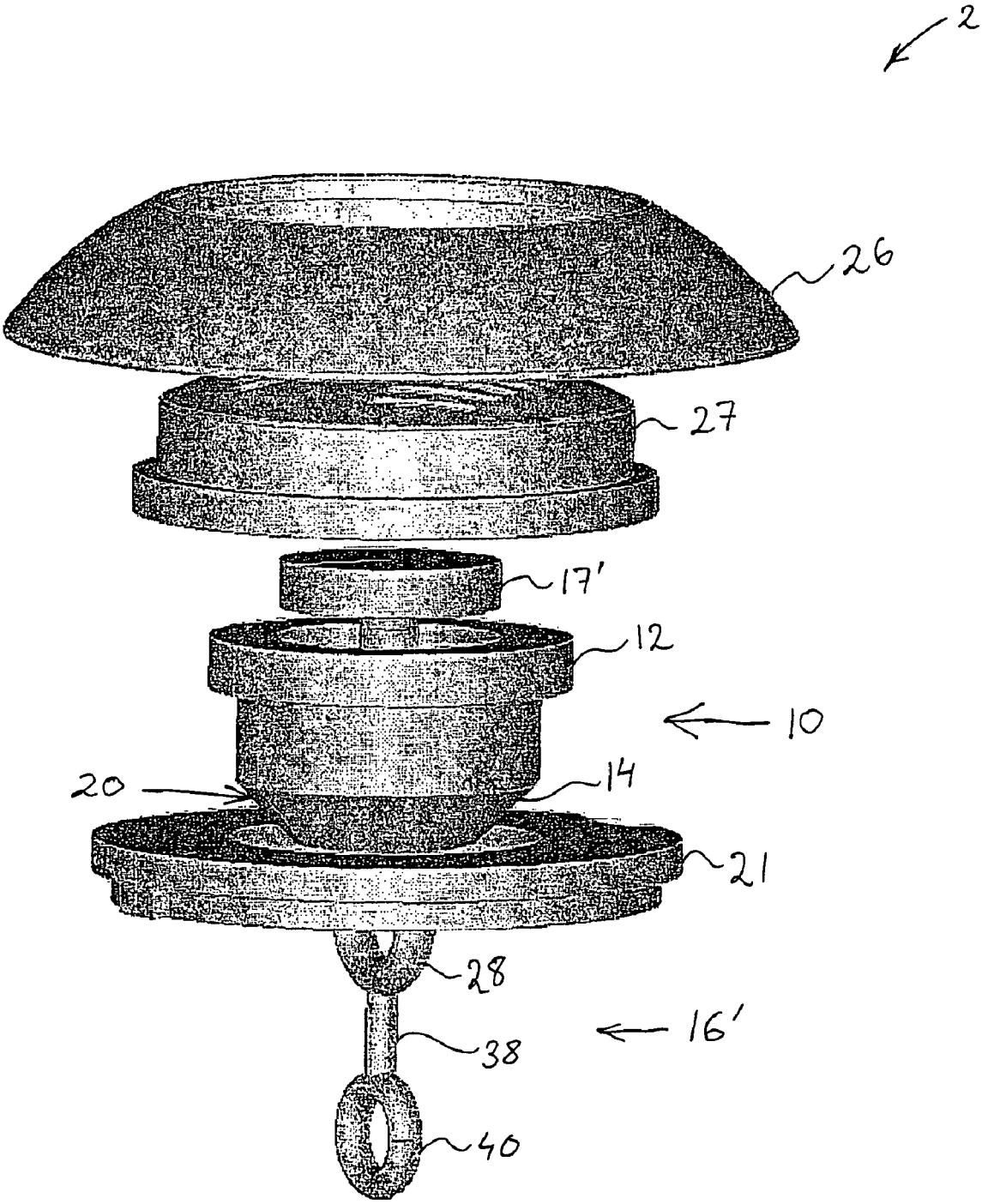
FIG. 2 shows the locking device in an exploded view, according to an alternative embodiment of the present invention.

FIG. 2 shows the locking device 2 according to an alternative embodiment of the present invention. The only difference compared to the embodiment according to FIGS. 1A-B is that the locking device 2 comprises a resilient lower portion 16' that has an outer extending portion 38, having a ring-shaped part 40 in the end, which outer portion 38 is arranged to extend from the ring-shaped portion 28. The other features correspond to the embodiment in FIG. 1A-B and are denoted with the same reference numerals as in FIG. 1A-B.

The invention claimed is:

1. Locking device (2) for fixation of the position of an outer layer (4) relative to an inner layer (6), of a protective helmet (3), the outer layer is displaceable, relative to the inner layer during an oblique impact towards the protective helmet, characterized in that the locking device (2) comprises a layer-guiding member (10), that has an upper portion (12), which upper portion (12) is intended to be arranged in an opening (13) in the outer layer (4), and a resilient lower portion (16), extending from the upper portion (12), that in its free end (17) is arranged in connection to the inner layer (6), whereby the upper portion (12) is arranged in a first position (P1) relative to the inner layer (6), in such a way that the outer layer (4) is fixed in position relative to the inner layer (6) in an unloaded condition, or during insignificant load on the protective helmet, the locking device (2) is arranged such that the fixed position ends when exceeding a certain load towards the protective helmet, owing to that the lower portion (16) of the layer-guiding member (10) can be elastic in its longitudinal direction (L) and in the direction of propagation plane (P) of the inner layer and the outer layer (4, 6), whereby the upper portion (12) of the locking device (2) can be moved to a second position (P2) relative to the inner layer (6), during displacement of the outer layer (4) relative to the inner layer (6), and that the locking device comprises a display member that indicates when displacement has taken place to the second position (p2).

2. Locking device (2) according to claim 1, characterized in that the inner layer (6) is designed with a cup-shaped portion (18), where a tapering portion (14) of the layer-guiding member and the cup-shaped portion (18) abut against each other, at least along an oblique section or an oblique surface (20), whereby the upper portion (12) with the tapering portion (14) of the layer-guiding member (10) can be displaced relative to the cup-shaped portion (16) of the inner layer (6), when the fixed positioning ends.

3. Locking device (2) according to claim 2, characterized in that the cup-shaped portion (18) of the inner layer (6) respectively the oblique surface (20) of the layer-guiding member (10), where they abut against each other, are flat surfaces, with an inclination in the range 30-60° relative to the propagation plane (P).

4. Locking device (2) according claim 1, characterized in that the locking device comprises a ring-formed washer (21) that is attached in the opening (13) to the outer layer (4), in which the upper portion (12) is displaceably arranged in the ring-formed washer (21) in an opening (22) of the ring-formed washer (21).

5. Locking device (2) according to claim 1, characterized in that the display member comprises a button device (24) arranged to the outer layer on the outside of the protective helmet adjacent to the upper portion (12) of the guiding member (10), and arranged such that a button part (27) of the button device (24) is pushed out by the upper portion (12) when said fixed position has ceased and displacement of the outer layer (4) relative to the inner layer (6) has taken place.

6. Locking device (2) according to claim 1, characterized in that the resilient lower portion (16) comprise a ring-shaped portion (28) in the free end (17), that is intended to be arranged in said connection with the inner layer (6).

7. Locking device (2) according claim 1, characterized in that the lower portion (16) is designed with material properties such that impact energy is absorbed during deformation of the lower portion, when the lower portion (16) is resiliently extended from said first position (FI).

8. Locking device (2) according to any of the preceding claims, characterized in that a stop member (30) is arranged to the inner layer (6) and in connection to the free end (17), such that the free end (17) is retained in its position during movement of the upper portion (12) to the second position (P2).

9. Locking device (2) according to claim 1, characterized in that the upper portion (12) of the layer-guiding member (10) has a circumferential surface (Y) with an angular shape.

10. Protective helmet comprising a locking device (2) according to claim 1.

11. Protective helmet according to claim 10, characterized in that the protective helmet comprise an attachment member (32), which attachment, member secures the outer layer (4) relatively the inner layer (6) in unloaded condition, or at insignificant load towards the protective helmet, and which attachment member (32) is arranged such that the fixation ends when exceeding a certain load towards the protective helmet.

* * * * *